US006041131A

United States Patent [19]

Kirchhoefer et al.

[11] Patent Number: 6,041,131

[45] Date of Patent: Mar. 21, 2000

[54] SHOCK RESISTANT ELECTROACOUSTIC TRANSDUCER

[75] Inventors: Dennis Ray Kirchhoefer, Plainfield; Thomas Edward Miller, Arlington Heights; Paris Tsangaris, Naperville, all of Ill.

[73] Assignee: Knowles Electronics, Inc., Itasca, Ill.

[21] Appl. No.: 08/890,075

[22] Filed: Jul. 9, 1997

[51] Int. Cl.[7] ..... H04R 1/00

[52] U.S. Cl. ..... 381/415; 381/413; 381/397

[58] Field of Search ..... 381/397, 396, 381/412, 413, 414, 415, 312, 417, 418, 322

[56] References Cited

U.S. PATENT DOCUMENTS

| | | | |
|---|---|---|---|
| 3,681,525 | 8/1972 | Wada et al. . | |
| 4,034,941 | 7/1977 | Godet . | |
| 4,123,675 | 10/1978 | Moskowitz et al. . | |
| 4,272,654 | 6/1981 | Carlson . | |
| 4,414,437 | 11/1983 | Trauernicht et al. | 379/415 |
| 4,992,190 | 2/1991 | Shtarkman | 252/52.52 |
| 5,243,662 | 9/1993 | Sogn et al. | 381/312 |
| 5,255,328 | 10/1993 | Akiniwa et al. . | |
| 5,335,287 | 8/1994 | Athanas . | |
| 5,461,677 | 10/1995 | Raj et al. . | |
| 5,647,013 | 7/1997 | Salvage et al. | 379/312 |
| 5,757,946 | 5/1998 | Van Schyndel | 381/415 |
| 5,850,682 | 12/1998 | Ushiro | 29/602.1 |

FOREIGN PATENT DOCUMENTS

| | | |
|---|---|---|
| 2 660 382-AI | 3/1990 | France . |
| 2660382A1 | 10/1991 | France . |
| 2083452 | 3/1982 | United Kingdom . |

OTHER PUBLICATIONS

Patent Abstracts of Japan by Temuko Japan, published Jun. 8, 1993, publication No. 05199577.

*Primary Examiner*—Paul Loomis
*Assistant Examiner*—Rexford N Barnie
*Attorney, Agent, or Firm*—Wallenstein & Wagner, Ltd.

[57] ABSTRACT

The present invention relates to a hearing aid receiver (10) having a coil (12) with a tunnel (14) therethrough, a magnetic structure (16) having a central magnetic gap (18), an armature (20), and a fluid (30, 32) with a viscosity greater than air to provide shock protection to the receiver (10). The tunnel (14) and the magnetic gap (18) collectively form an armature aperture (28). The armature (20) extends through the armature aperture (28). The fluid (30, 32) lies within the armature aperture (28).

9 Claims, 7 Drawing Sheets

SHOCK RESISTANT ELECTROACOUSTIC TRANSDUCER

TECHNICAL FIELD

The present invention relates to electroacoustic transducers with shock protection. More particularly, the present invention relates to the use of fluid having a viscosity greater than air within an electroacoustic transducer to provide shock protection.

BACKGROUND OF THE INVENTION

Electroacoustic transducers typically include a pair of spaced permanent magnets forming a magnetic gap, a coil having a tunnel therethrough, and a reed armature. The armature is attached to a diaphragm by a drive rod. In normal operation, the armature does not contact the magnets or the coil. The armature can be easily damaged by over-deflection if the transducer experiences a shock, e.g., from being dropped. Because decreasing the size of an electroacoustic transducer decreases the tolerance of the transducer, the affect of shock on transducers becomes more significant as smaller transducers are designed.

One method of providing shock protection to a transducer is to limit the degree of deflection of the armature. For example, U.S. patent application Ser. No. 08/416,887, filed on Jun. 2, 1995, and allowed on Jan. 7, 1997, discloses a formation and/or a restriction on the armature to limit the deflection of the armature.

Magnetic fluid is known for its use in loudspeakers to dissipate heat by increasing the thermal conduction from the voice coil to the metal motor components. Loudspeakers require these heat dissipaters because they are very inefficient, and therefore, most of the power required to operate the loudspeakers is converted into heat.

SUMMARY OF THE INVENTION

The present invention provides shock protection, thus, reducing possible damage to electroacoustic transducers by placing fluid having a viscosity greater than air between the armature and any stationary element of the transducer. The present invention may also result in acoustical damping of the transducers.

In one embodiment of the present invention, the fluid is placed within the tunnel of the coil. In a second embodiment, the fluid is placed within the magnetic gap between the first magnet and the second magnet.

The use of fluid in an electroacoustic transducer may eliminate the need for components in the transducers, such as reed snubbers, dedicated to providing shock resistance. The use of fluids in the transducer may also eliminate the need for dampening components or methods typically used in hearing aid receivers, e.g., screen dampers in the output tubes, precision piercing of receiver diaphragms, and viscous damping materials between the armature and the static receiver component used to dampen undesirable armature vibrational modes. The presence of fluids in transducers may also serve to reduce or eliminate the corrosion on the surface of any metallic components with which the fluids come into contact. These metallic components include the armature, magnets, stack, coil, etc.

DETAILED DESCRIPTION OF THE PREFERRED EMBODIMENT

While this invention is susceptible of embodiments in many different forms, there will herein be described in detail preferred embodiments of the invention with the understanding that the present disclosure is to be considered as exemplifications of the principles of the invention and is not intended to limit the broad aspects of the invention of the embodiments illustrated.

Although the shock resistant electroacoustic transducer is described as an electroacoustic receiver, the shock protection of the present invention may be applied to dynamic microphones as well.

Figure 1:
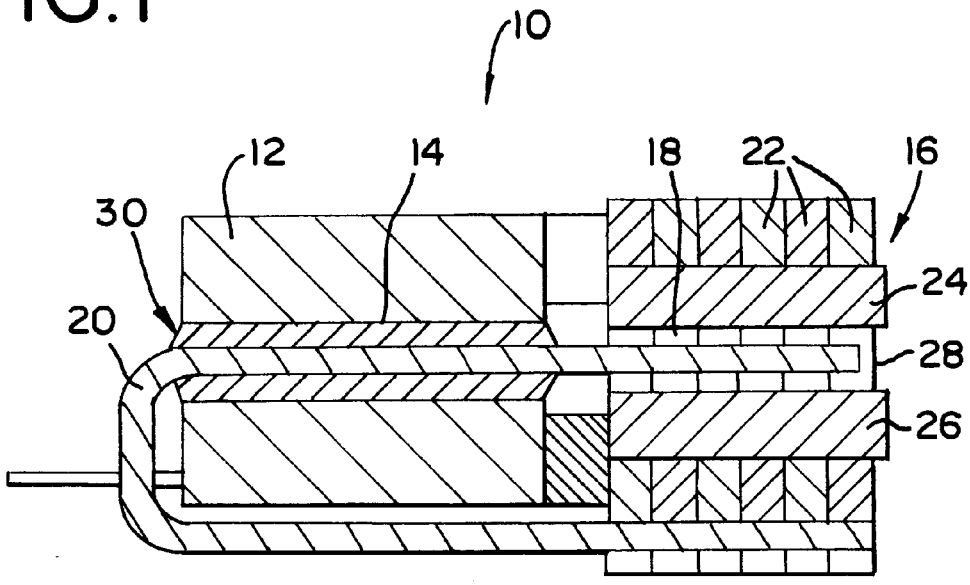
FIG. 1 is a side view of a first embodiment of an electroacoustic receiver in accordance with the present invention.
Figure 2:
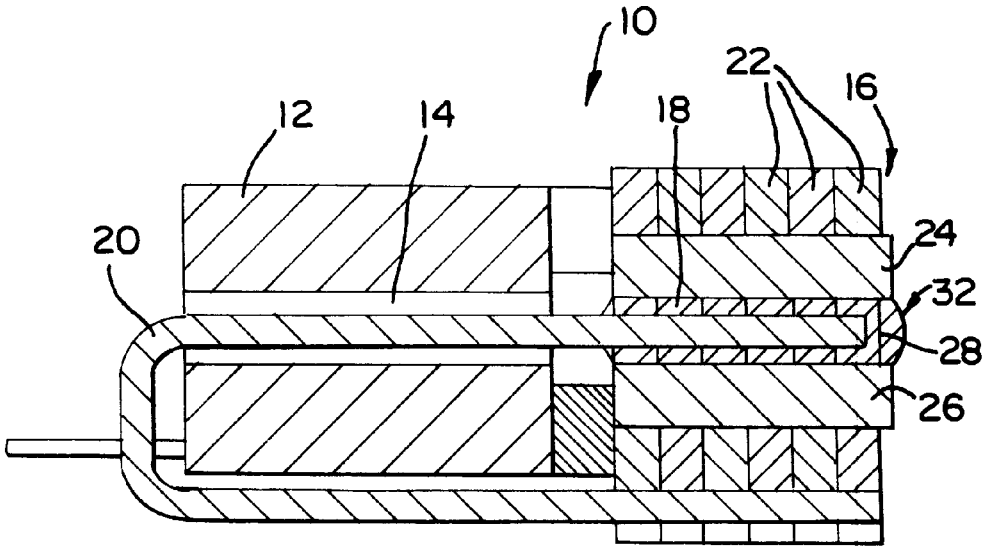
FIG. 2 is a side view of a second embodiment of an electroacoustic receiver in accordance with the present invention.

FIGS. 1 and 2 exemplify two embodiments of an electroacoustic receiver 10 of the present invention. Referring to FIG. 1 and the first embodiment, the receiver 10 comprises a coil 12 having a tunnel 14 therethrough, a permanent magnet structure 16 having a central magnetic gap 18, and an armature 20. The permanent magnet structure 16 provides a permanent magnetic field within the magnetic gap 18. The permanent magnet structure 16 comprises a stack of ferromagnetic laminations 22, each having an aligned central lamination aperture. A pair of permanent magnets 24, 26 are disposed within the lamination apertures and cemented to opposite faces thereof. The tunnel 14 in the coil 12 and the magnetic gap 18 collectively form an armature aperture 28 through which the armature 20 extends. A damping fluid or compound 30 is introduced into the coil tunnel 14 of the receiver 10 to improve the shock resistance of the receiver and to facilitate damping. The damping fluid 30 has a viscosity greater than air, and may be in the form of pastes, gels or other high viscosity fluids. Capillary action retains the fluid within the coil tunnel.

In the second embodiment, shown in FIG. 2, a damping fluid or compound 32 is introduced into the magnetic gap 18 of the receiver 10 rather than the coil tunnel 14. In all other respects, the receiver 10 of FIG. 2 is the same as the receiver 10 illustrated in FIG. 1.

In a preferred embodiment, the receiver 10 incorporates a magnetic fluid, i.e., a colloidal suspension of soft magnetic particles in oil, as the damping fluid 32 within the magnetic gap 18. The magnetic particles help to retain the fluid 32 within the magnetic gap 18, and have no material magnetic effect on the receiver operation.

The viscosity of the fluid 30, 32 is directly related to the shock resistance and damping of the receiver 10. Thus, increasing the viscosity of the fluid 30, 32 increases the damping. Increasing the density of the magnetic particles in the fluid increases the viscosity of the fluid, thus increasing the shock resistance and damping. Therefore, the magnetic saturation level of the magnetic damping fluid is also directly related to damping.

The viscosity of the fluid in the present invention is between 1–50 centipoise (cp). More particularly, the viscosity of the fluid in the present invention is between 12.5–37.5 cp. The preferred viscosity is 25 cp.

The effect of the viscosity of the damping fluid depends on its placement within the receiver. Specifically, because there is less movement of the armature closer to the central portion of the armature rather than the tip, the fluid placed within the armature gap closer to the tip of the armature must have a lower viscosity than the fluid placed closer to the central portion of the armature to have the same damping effect on the receiver.

Figure 3:
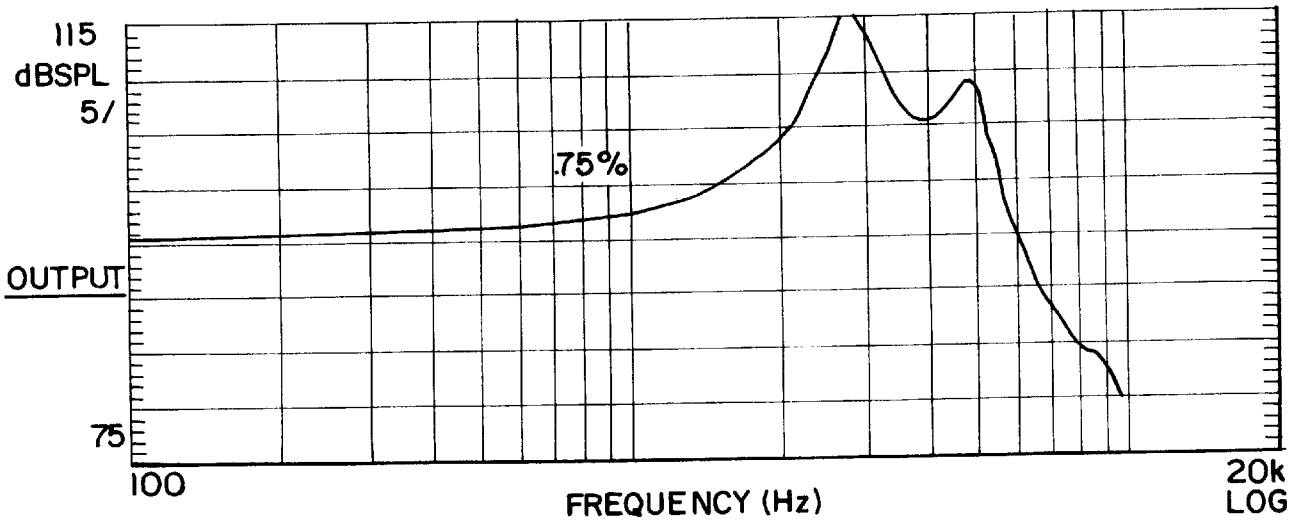
FIG. 3 is the response curve of a conventional hearing aid receiver.
Figure 4:
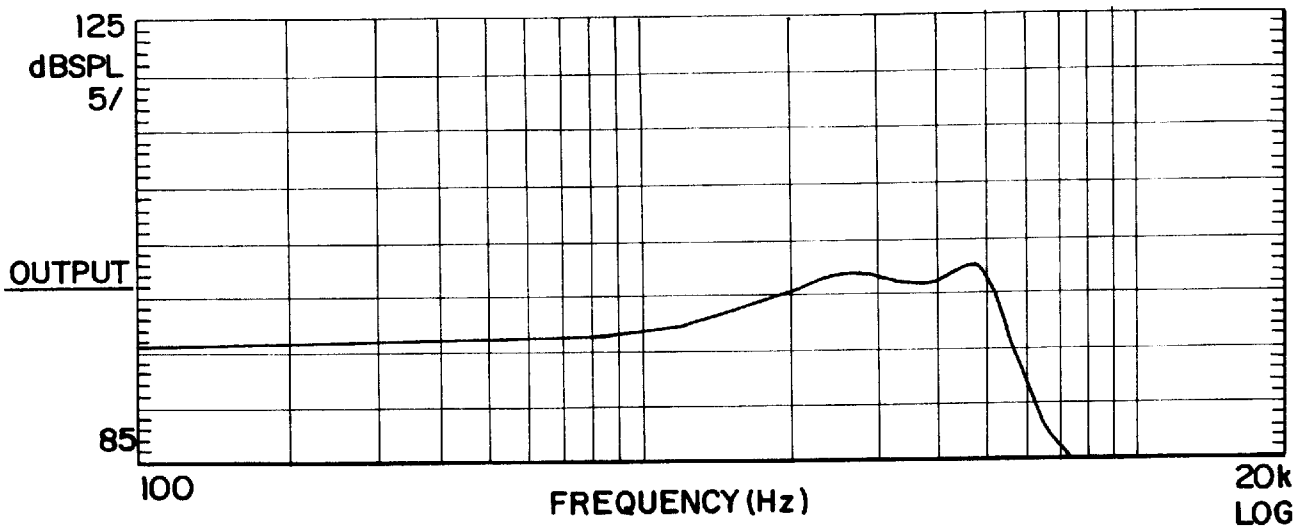
FIG. 4 is the response curve of the electroacoustic receiver of FIG. 2.

The response curve of a conventional hearing aid receiver at 1.03 milliamps rms (mArms), a standard power level to the drive unit, is shown in FIG. 3. The response curve of a conventional hearing aid receiver with magnetic fluid within the magnetic gap under the same conditions is shown in FIG. 4. The damping effect of the fluid within the magnetic gap is evident from a comparison of the two curves. Specifically, the peak response in the conventional hearing aid, which occurs between 2–3 KHz in FIG. 3, exceeds 115 dBSPL. With magnetic fluid in the magnetic gap of the receiver, the response at the same frequency reduces to ~104 dBSPL, as shown in FIG. 4.

Figure 5:
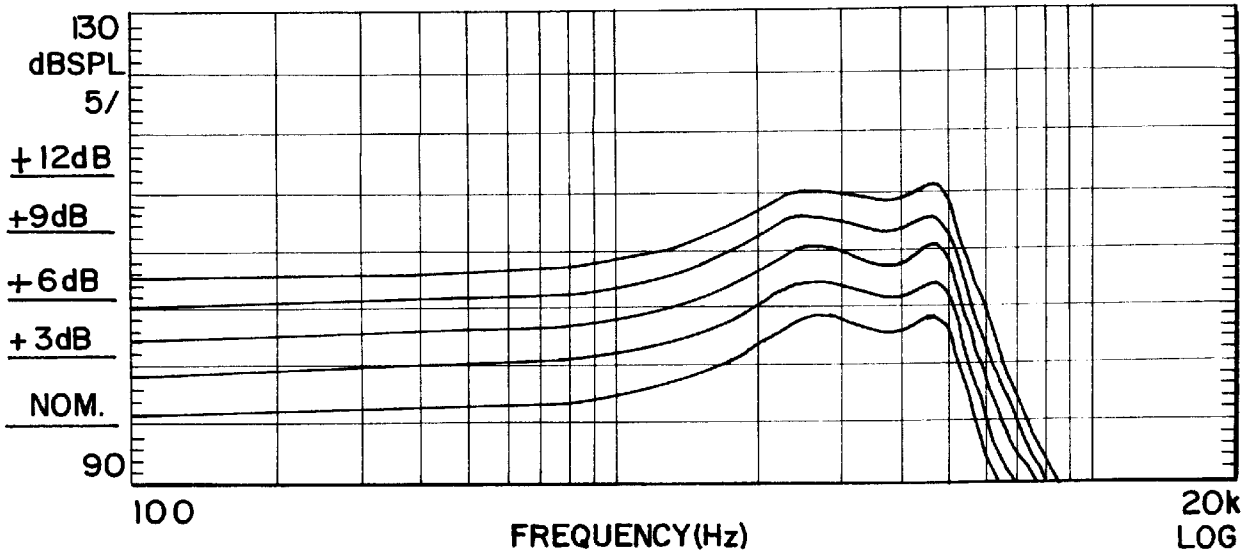
FIG. 5 is a second response curve of the electroacoustic receiver of FIG. 2.
Figure 6:
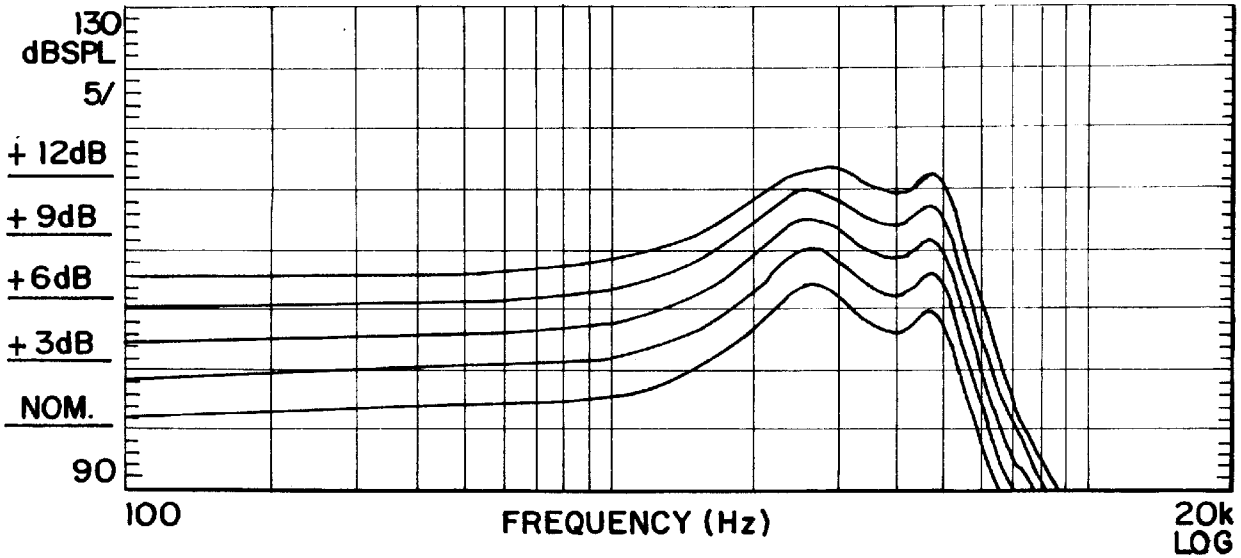
FIG. 6 is the response curve of the electroacoustic receiver of FIG. 2 after a drop equivalent to approximately 20,000 times the acceleration of gravity.

The response curve of a conventional hearing aid receiver with magnetic fluid within the magnetic gap at 1.03 mArms and incrementally higher power levels applied to the drive unit is shown in FIG. 5, and the response curve of the hearing aid receiver with magnetic fluid within the magnetic gap under the same conditions after an 80" drop, which is approximately 20,000 times the acceleration of gravity, i.e., 20,000 G, is shown in FIG. 6. Without damping fluid within the receiver, the damage to the armature would effectively destroy the receiver. As shown in FIG. 6, the result of dropping the receiver with magnetic damping fluid only increased the response curve slightly between 2–5 KHz.

Figure 7:
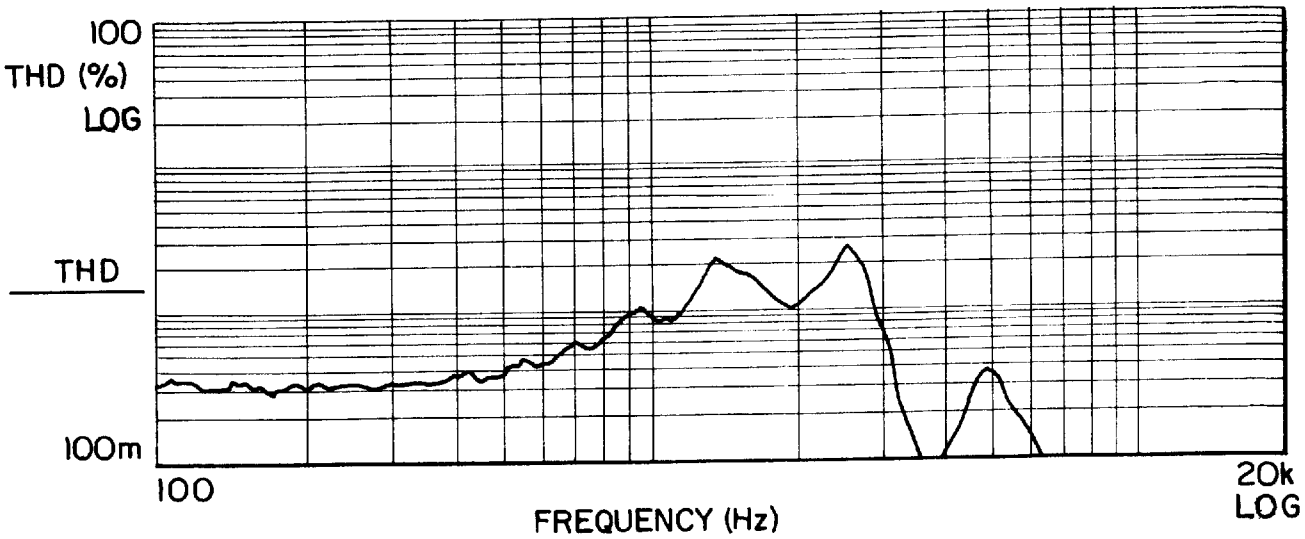
FIG. 7 is the distortion curve of a conventional hearing aid receiver.
Figure 8:
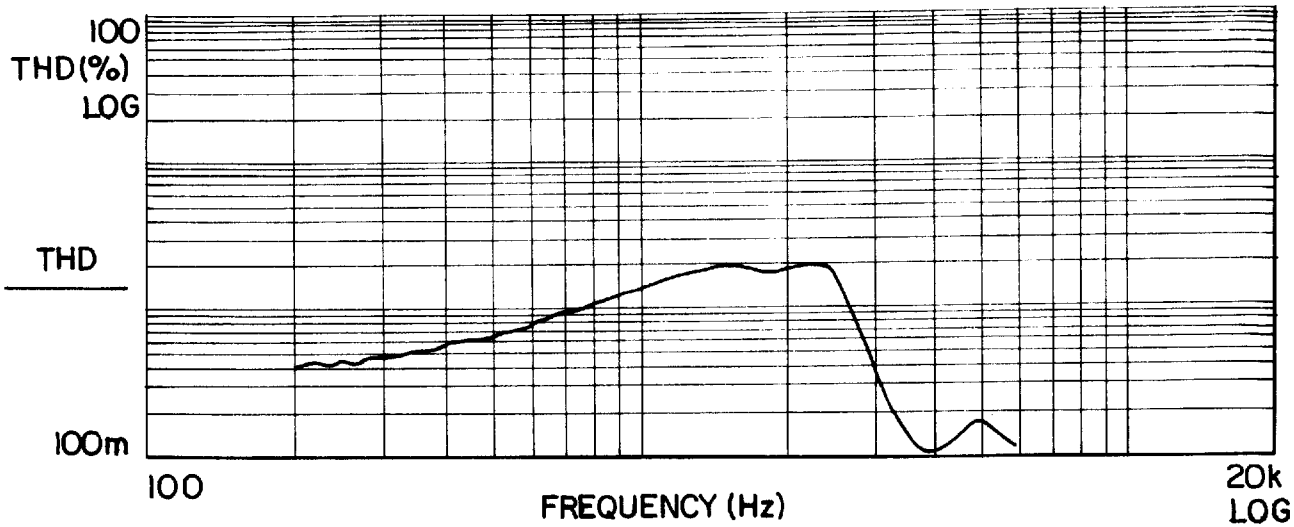
FIG. 8 is the distortion curve of the electroacoustic receiver of FIG. 2.

The total harmonic distortion (THD) of a conventional hearing aid receiver at 1.03 mArms is shown in FIG. 7, and the THD of a conventional hearing aid receiver with magnetic fluid within the magnetic gap under the same conditions is shown in FIG. 8. The THD is typically measured at ⅓ the first resonant peak frequency, i.e., at ~800 Hz. As shown in FIGS. 7 and 8, the THD at 800 Hz in a conventional hearing aid receiver with no damping fluid is ~0.6%, while the THD with fluid within the receiver is ~1%. Thus, the THD remains relatively consistent with the placement of fluid within the receiver.

Figure 9:
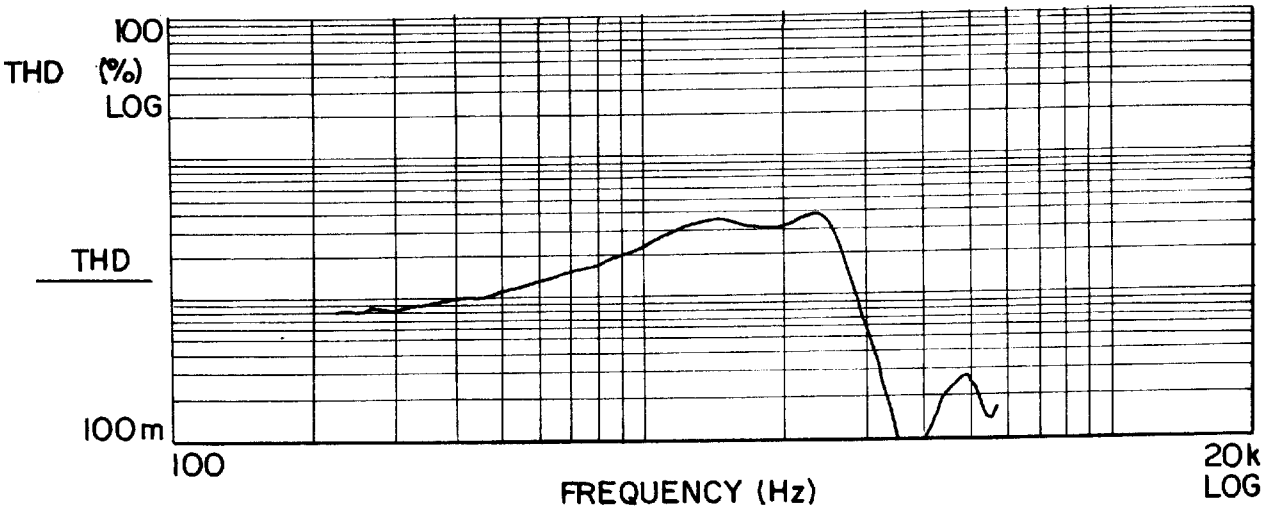
FIG. 9 is a second distortion curve of the electroacoustic receiver of FIG. 2.
Figure 10:
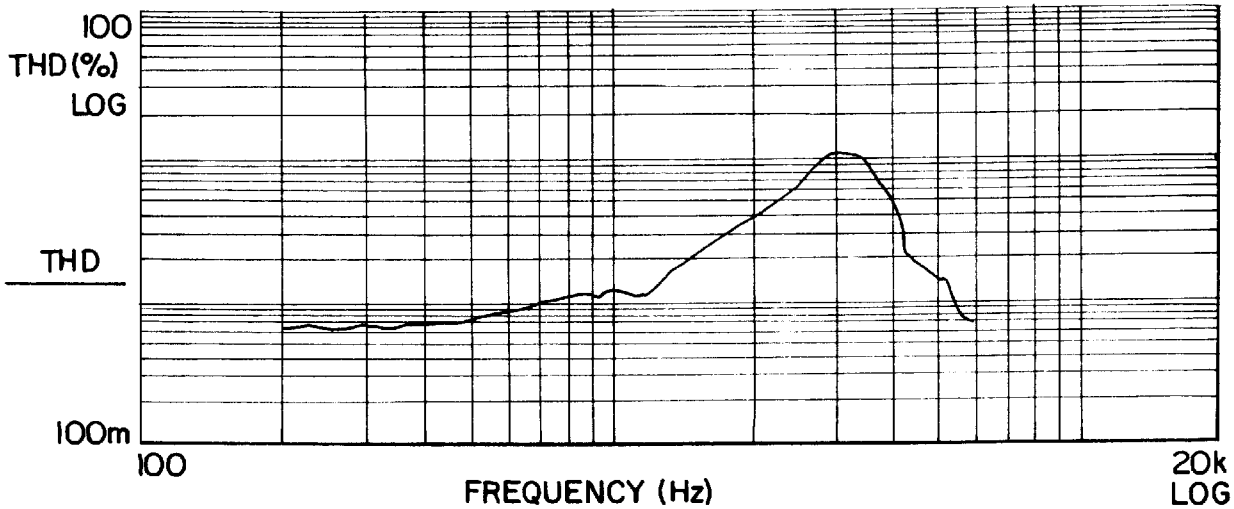
FIG. 10 is the distortion curve of the electroacoustic receiver of FIG. 2 after a drop equivalent to approximately 20,000 times the acceleration of gravity.

The THD of a conventional hearing aid receiver with magnetic fluid within the magnetic gap is shown in FIG. 9, and the THD of the conventional hearing aid receiver with magnetic fluid within the magnetic gap after a 20,000 G drop is shown in FIG. 10. The THD at 800 Hz before the drop is ~1–2%, while the THD at 800 Hz after the drop is ~1%. Thus, the THD remains relatively consistent after a 20,000 G drop with damping fluid within the receiver.

Figure 11:
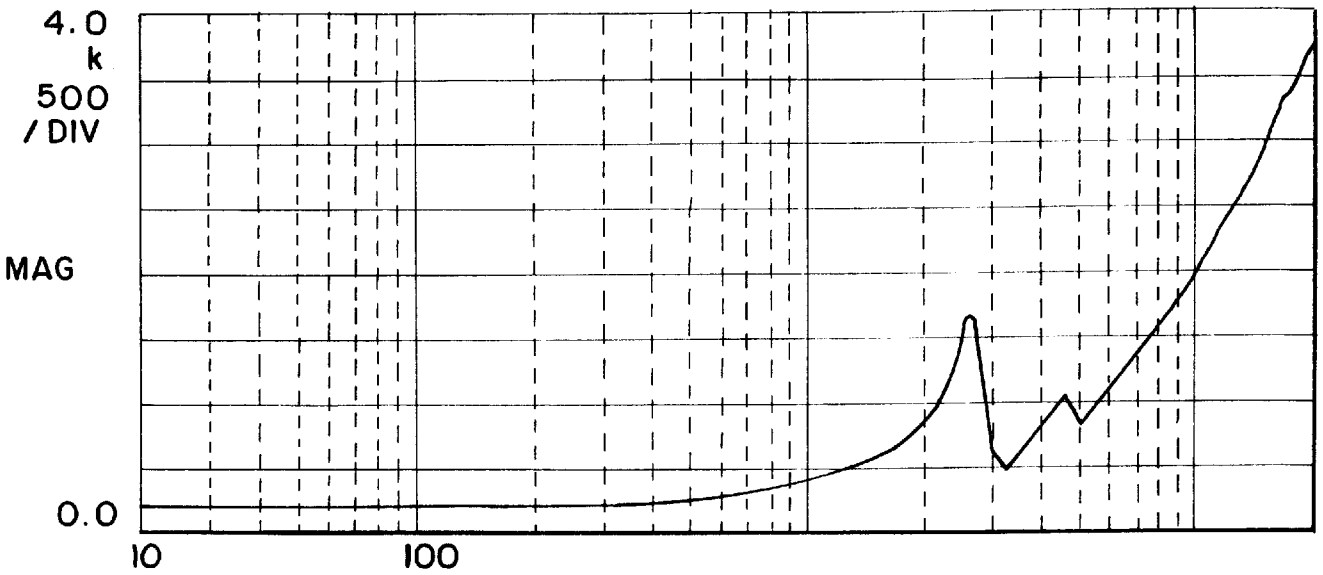
FIG. 11 is the impedance curve of a conventional hearing aid receiver.
Figure 12:
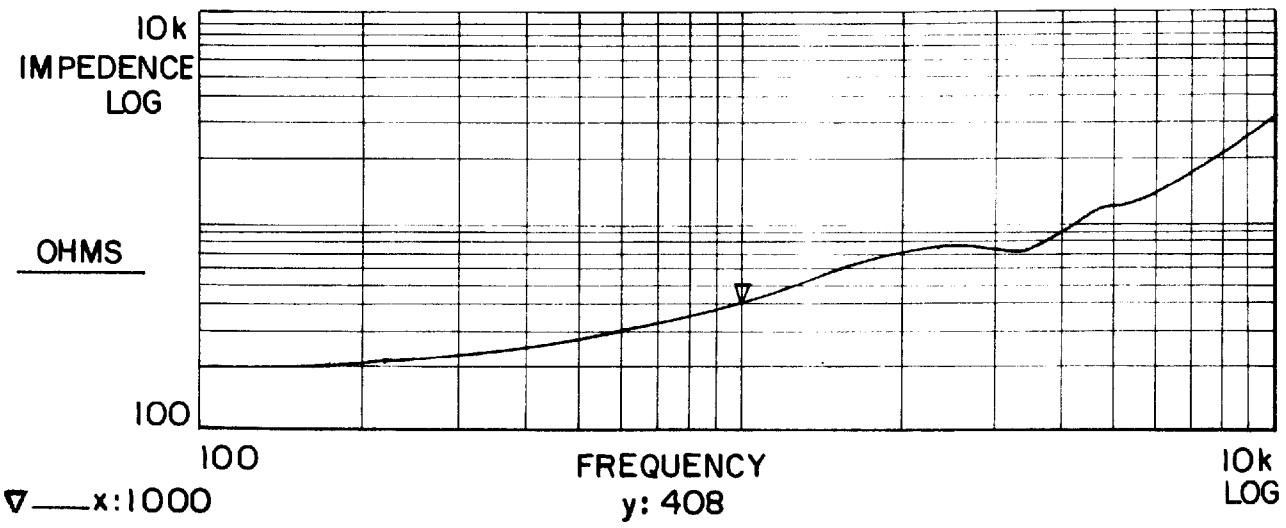
FIG. 12 is the impedance curve of the electroacoustic receiver of FIG. 2.

The impedance curve of a conventional hearing aid receiver at 1.03 mArms is shown in FIG. 11, and the impedance curve of a conventional hearing aid receiver with magnetic fluid within the magnetic gap under the same conditions is shown in FIG. 12. The damping effect of the fluid within the magnetic gap is evident from a comparison of the two curves. Specifically, the peak impedance in the conventional hearing aid, which occurs between 2.6–2.7 KHz in FIG. 11, is essentially eliminated with magnetic fluid in the receiver, as shown in FIG. 12.

Figure 13:
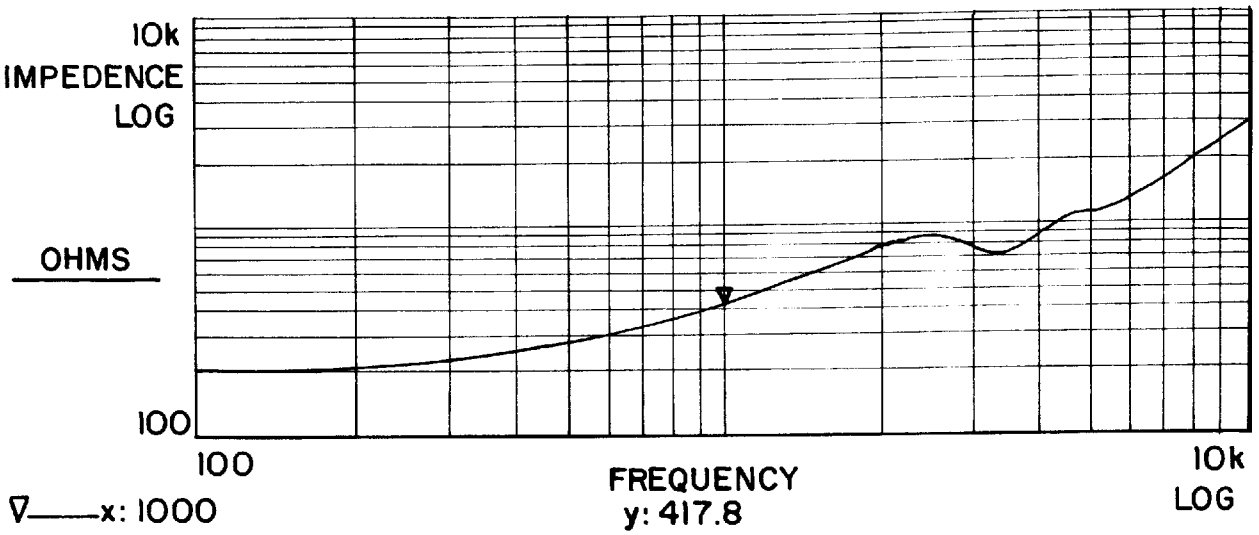
FIG. 13 is a second impedance curve of the electroacoustic receiver of FIG. 2.
Figure 14:
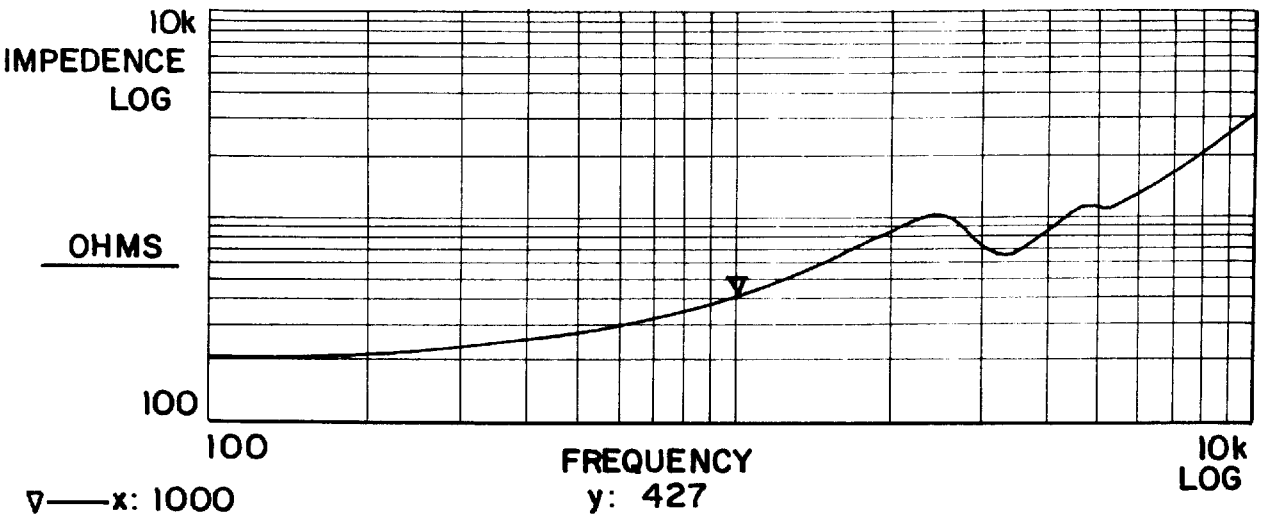
FIG. 14 is the impedance curve of the electroacoustic receiver of FIG. 2 after a drop equivalent to approximately 20,000 times the acceleration of gravity.

The impedance curve of a conventional hearing aid receiver with magnetic fluid within the magnetic gap is shown in FIG. 13, and the impedance curve of the conventional hearing aid receiver with magnetic fluid within the magnetic gap under the same conditions after a 20,000 G drop is shown in FIG. 14. As shown in FIG. 14, the result of dropping the receiver only increased the impedance curve slightly between 2.6–2.7 KHz. The impedance after the drop, however, is still lower than the impedance of the conventional hearing aid receiver with no damping fluid.

It will be understood that the invention may be embodied in other specific forms without departing from the spirit or central characteristics thereof. The present embodiments, therefore, are to be considered in all respects as illustrative and not restrictive, and the invention is not to be limited to the details given herein.

We claim:

1. A hearing aid transducer comprising:

a coil defining an elongated tunnel;

a magnet structure defining an elongated gap in axial alignment with the tunnel;

an armature aperture including the tunnel within the coil and the gap within the magnet structure;

an armature extending through the armature apertures; and a fluid with a viscosity greater than air within at least a portion of the armature aperture and at least partially maintained therein by capillary attraction.

2. The hearing aid transducer as claimed in claim 1, wherein said fluid comprises a paste.

3. The hearing aid transducer as claimed in claim 1, wherein said fluid comprises a gel.

4. The hearing aid transducer as claimed in claim 1, wherein said fluid is within the tunnel of said coil.

5. The hearing aid transducer as claimed in claim 1, wherein said fluid is within the gap of said magnet structure.

6. The hearing aid transducer as claimed in claim 5, wherein said fluid comprises a colloidal suspension of soft magnetic particles in oil.

7. The hearing aid transducer as claimed in claim 1, wherein the viscosity of said fluid is greater than 1 centipoise and less than 50 centipoise.

8. The hearing aid transducer as claimed in claim 7, wherein the viscosity of said fluid is greater than 12.5 centipoise and less than 37.5 centipoise.

9. The hearing aid transducer as claimed in claim 8, wherein the viscosity of said fluid is 25 centipoise.

* * * * *